US010655544B2

(12) United States Patent
Yamada et al.

(10) Patent No.: US 10,655,544 B2
(45) Date of Patent: May 19, 2020

(54) ENGINE

(71) Applicant: Yanmar Co., Ltd., Osaka-shi, Osaka-fu (JP)

(72) Inventors: Katsuhiro Yamada, Osaka (JP); Atsushi Uehara, Osaka (JP)

(73) Assignee: YANMAR CO., LTD., Osaka (JP)

( * ) Notice: Subject to any disclaimer, the term of this patent is extended or adjusted under 35 U.S.C. 154(b) by 101 days.

(21) Appl. No.: 15/765,550

(22) PCT Filed: Oct. 5, 2016

(86) PCT No.: PCT/JP2016/079633
§ 371 (c)(1),
(2) Date: Apr. 3, 2018

(87) PCT Pub. No.: WO2017/061473
PCT Pub. Date: Apr. 13, 2017

(65) Prior Publication Data

US 2018/0291821 A1 Oct. 11, 2018

(30) Foreign Application Priority Data

Oct. 7, 2015 (JP) ..... 2015-199454

(51) Int. Cl.
*F02D 1/08* (2006.01)
*F02D 41/04* (2006.01)
(Continued)

(52) U.S. Cl.
CPC ..... *F02D 1/08* (2013.01); *F02D 41/04* (2013.01); *F02D 41/1408* (2013.01);
(Continued)

(58) Field of Classification Search
CPC .... F02D 1/08; F02D 41/04; F02D 2041/2027; F02D 2041/2031
(Continued)

(56) References Cited

U.S. PATENT DOCUMENTS 4,493,302 A * 1/1985 Kawamura ..... F02D 41/401 123/357
5,706,780 A * 1/1998 Shirakawa ..... F02D 41/005 123/381
(Continued)

FOREIGN PATENT DOCUMENTS

JP 2006-207376 A 8/2006
JP 2009-085063 A 4/2009
JP 2014-062530 A 4/2014

OTHER PUBLICATIONS

International Search Report dated Dec. 13, 2016 issued in corresponding PCT Application PCT/JP2016/079633.

*Primary Examiner* — John Kwon
*Assistant Examiner* — Johnny H Hoang
(74) *Attorney, Agent, or Firm* — Norton Rose Fulbright US LLP

(57) ABSTRACT

An engine comprising: a fuel injection device including a rack and an actuator, the rack being configured to regulate the amount of fuel injected to a combustion chamber, the actuator being configured to control the position of the rack; and a control device that controls fuel injection performed by the fuel injection device based on an instructed revolution number, and that performs a dither control on the actuator, wherein the control device has information of a revolution number variation region that is based on the relationship between a dither frequency in the dither control and an engine revolution number, and upon determining that the instructed revolution number is within the revolution number variation region, changes at least one of the dither frequency and the instructed revolution number. Thus, an engine capable of reducing a periodic variation in engine speed which may be caused by a dither control is provided.

18 Claims, 5 Drawing Sheets

(51) Int. Cl.

| | |
|---|---|
| ***F02D 41/14*** | (2006.01) |
| *F02D 41/20* | (2006.01) |
| *F02M 59/26* | (2006.01) |
| *F02M 59/04* | (2006.01) |
| *F02M 59/10* | (2006.01) |

(52) U.S. Cl.
CPC ..... *F02D 41/1498* (2013.01); *F02D 41/20* (2013.01); *F02D 2001/085* (2013.01); *F02D 2200/101* (2013.01); *F02M 59/04* (2013.01); *F02M 59/102* (2013.01); *F02M 59/265* (2013.01)

(58) Field of Classification Search
USPC ..... 123/445, 456, 490, 497, 406.38, 406.39, 123/406.47; 701/102–105
See application file for complete search history.

(56) References Cited

U.S. PATENT DOCUMENTS

| | | | | |
|---|---|---|---|---|
| 5,996,557 | A * | 12/1999 | Muraki | F02D 41/401 123/502 |
| 6,840,220 | B2 * | 1/2005 | Yomogida | F02D 41/3809 123/456 |
| 7,715,949 | B2 * | 5/2010 | Sato | F02M 61/14 188/378 |
| 2010/0108030 | A1 * | 5/2010 | Kusaka | F02D 31/007 123/357 |

* cited by examiner

FIG. 4

REVOLUTION NUMBER VARIATION REGION BASED ON RELATIONSHIP BETWEEN DITHER FREQUENCY (HZ) AND ENGINE REVOLUTION NUMBER (RPM)

| Hz | 1 | 2 | 3 | 4 | 5 | 6 | 7 | 8 | 9 |
|---|---|---|---|---|---|---|---|---|---|
| 178.6 | 10716 | 5358 | 3572 | 2679 | 2143 | 1786 | 1531 | 1340 | 1191 |
| 166.7 | 10002 | 5001 | 3334 | 2501 | 2000 | 1667 | 1429 | 1250 | 1111 |
| 156.3 | 9378 | 4689 | 3126 | 2345 | 1876 | 1563 | 1340 | 1172 | 1042 |
| 147.1 | 8826 | 4413 | 2942 | 2207 | 1765 | 1471 | 1261 | 1103 | 981 |
| 138.9 | 8334 | 4167 | 2778 | 2084 | 1667 | 1389 | 1191 | 1042 | 926 |
| 131.6 | 7896 | 3948 | 2632 | 1974 | 1579 | 1316 | 1128 | 987 | 877 |
| 125 | 7500 | 3750 | 2500 | 1875 | 1500 | 1250 | 1071 | 938 | 833 |

ENGINE

CROSS REFERENCES TO RELATED APPLICATIONS

This application is a national stage application pursuant to 35 U.S.C. § 371 of International Application No. PCT/JP2016/079633, filed on Oct. 5, 2016, which claims priority under 35 U.S.C. § 119 to Japanese Patent Application No. 2015-199454, filed on Oct. 7, 2015, the disclosures of which are hereby incorporated by reference in their entireties.

TECHNICAL FIELD

The present invention relates to an engine.

BACKGROUND ART

Examples of the conventional engines include a diesel engine shown in Patent Literature 1 (PTL 1). The diesel engine of PTL 1 includes a control device and an electronic governor, and the electronic governor includes an electric actuator and a fuel metering rack. The control device controls the electric actuator such that an output part of the electric actuator reciprocates. The reciprocation of the output part of the electric actuator causes the fuel metering rack to reciprocatingly slide with a predetermined stroke. This diesel engine, in which the position of the fuel metering rack is adjusted in the above-described manner, regulates the amount of fuel to be injected into a combustion chamber.

The diesel engine of PTL 1 performs a dither control in which the electric actuator finely vibrates the fuel metering rack. Performing the dither control can reduce a frictional force because static friction in the electric actuator and a movable part of the fuel metering rack becomes kinetic friction, thus enabling a control with an enhanced responsiveness.

CITATION LIST

Patent Literature

Patent Literature 1: Japanese Patent Application Laid-Open No. 2014-62530

SUMMARY OF INVENTION

Technical Problem

The present inventors discovered that an engine including an electronic governor may sometimes cause the following problem. In detail, the present inventors discovered that performing a dither control of exciting an actuator at a specific frequency may sometimes cause a periodic variation in the engine speed at a specific engine speed (i.e., revolutions per minute; hereinafter revolution number). The present inventors also discovered that occurrence of the periodic variation may sometimes lead to a harsh noise (audible sound) at a specific frequency.

An object of the present invention is to provide an engine capable of suppressing a periodic variation in the engine speed which may be caused by a dither control.

Solution to Problem

To attain the above object, an engine of the present invention is configured as follows.

An engine according to an aspect of the present invention includes: a fuel injection device including a rack and an actuator, the rack being configured to regulate the amount of fuel injected to a combustion chamber, the actuator being configured to control the position of the rack; and a control device that controls fuel injection performed by the fuel injection device based on an instructed revolution number, and that performs a dither control on the actuator, wherein the control device has information of a revolution number variation region that is based on the relationship between a dither frequency in the dither control and an engine revolution number, and upon determining that the instructed revolution number is within the revolution number variation region, changes at least one of the dither frequency and the instructed revolution number.

Advantageous Effects of Invention

The engine according to an aspect of the present invention can reduce a periodic variation in engine speed, which may be caused by a dither control.

DESCRIPTION OF EMBODIMENTS

Figure 1:
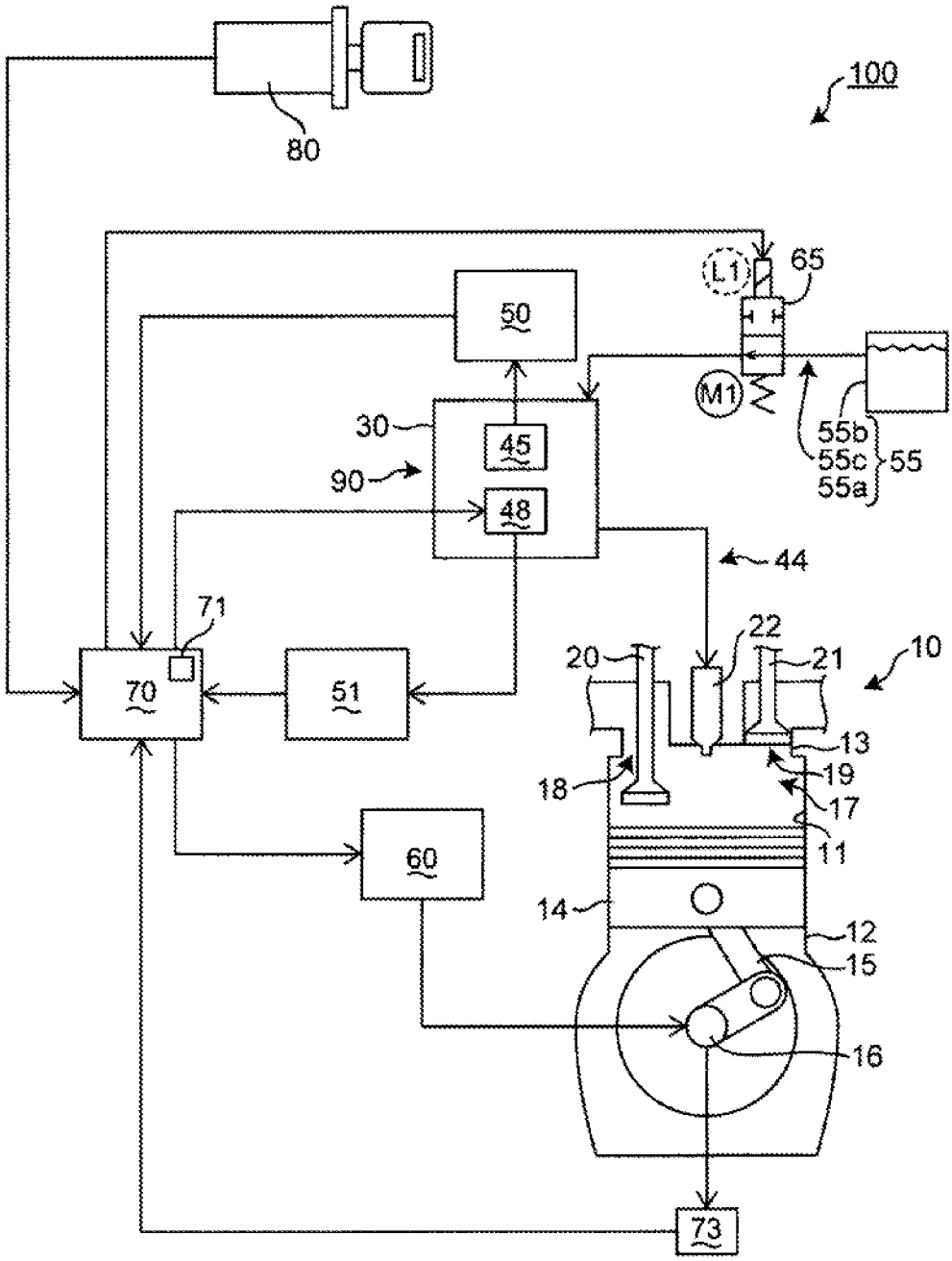
FIG. 1 A diagram conceptually showing a configuration of a diesel engine according to an embodiment of the present invention FIG. 2 A schematic cross-sectional view of a fuel injection pump provided in the engine of FIG. 1

An engine according to a first aspect of the present invention includes: a fuel injection device including a rack and an actuator, the rack being configured to regulate the amount of fuel injected to a combustion chamber, the actuator being configured to control the position of the rack; and a control device that controls fuel injection performed by the fuel injection device based on an instructed revolution number, and that performs a dither control on the actuator, wherein the control device has information of a revolution number variation region that is based on the relationship between a dither frequency in the dither control and an engine revolution number, and upon determining that the instructed revolution number is within the revolution number variation region, changes at least one of the dither frequency and the instructed revolution number.

This configuration can avoid the revolution number variation region by changing at least either one of the dither frequency and the instructed revolution number, so that a periodic variation in the revolution number, which may be caused by the dither control, can be reduced. In addition, an unpleasant audible sound which may be sometimes caused by the periodic variation in the revolution number can be reduced.

An engine according to a second aspect of the present invention is the engine of the first aspect, wherein upon determining that the instructed revolution number is within the revolution number variation region, the control device increases or decreases the revolution number relative to the instructed revolution number, to obtain a corrected revolution number that is outside the revolution number variation region, and controls fuel injection performed by the fuel injection device based on the corrected revolution number.

An engine according to a third aspect of the present invention is the engine of the first aspect, wherein upon determining that the instructed revolution number is within the revolution number variation region, the control device changes the dither frequency so as to bring the instructed revolution number out of the revolution number variation region, and performs the dither control on the actuator based on the dither frequency obtained by the change.

An engine according to a fourth aspect of the present invention is the engine of any of first to third aspects, further including: a revolution number detection device that detects the revolution number of a crankshaft; and a position detection device that detects the position of the rack, wherein the control device prepares the information of the revolution number variation region based on at least one type of information among information of the revolution number detected by the revolution number detection device, information of the position of the rack detected by the position detection device, and information of the amount of fuel injected by the fuel injection device.

This configuration enables the control device to prepare the information of the revolution number variation region that is based on the relationship between the dither frequency and the engine revolution number by learning from data obtained while the engine is driving, not from preliminarily input information.

(Embodiments)

In the following, an embodiment of this disclosure will be described in detail based on the drawings.

FIG. 1 is a diagram conceptually showing a configuration of a diesel engine according to an embodiment of the present invention.

As shown in FIG. 1, the diesel engine (hereinafter simply referred to as engine) 100 includes an engine body 10, a fuel injection pump 30, a fuel supply unit 55, a starter 60, a shut-off valve 65, and a control device 70. In this embodiment, the fuel injection pump 30 and the shut-off valve 65 constitute a fuel injection device 90.

The engine body 10 has a cylinder block 12 and a cylinder head 13. The cylinder head 13 is disposed at the upper end of the cylinder block 12. The cylinder block 12 is provided with a plurality of cylinders 11. In each of the cylinders 11, a piston 14 is reciprocably fitted by insertion. The piston 14 is coupled to a crankshaft 16 via a connection rod 15. A combustion chamber 17 is defined between the upper end of the piston 14 and the lower end of the cylinder head 13. The cylinder head 13 has an air supply port 18 and an exhaust port 19.

The engine includes an intake valve 20 and an exhaust valve 21. The intake valve 20 opens and closes an opening of the air supply port 18 on the combustion chamber 17 side. The exhaust valve 21 opens and closes an opening of the exhaust port 19 on the combustion chamber 17 side. The cylinder head 13 has a fuel injection nozzle 22. The fuel injection nozzle 22 has its distal end portion protruding into the combustion chamber 17. The fuel injection pump 30 supplies a fuel to the fuel injection nozzle 22.

Figure 2:
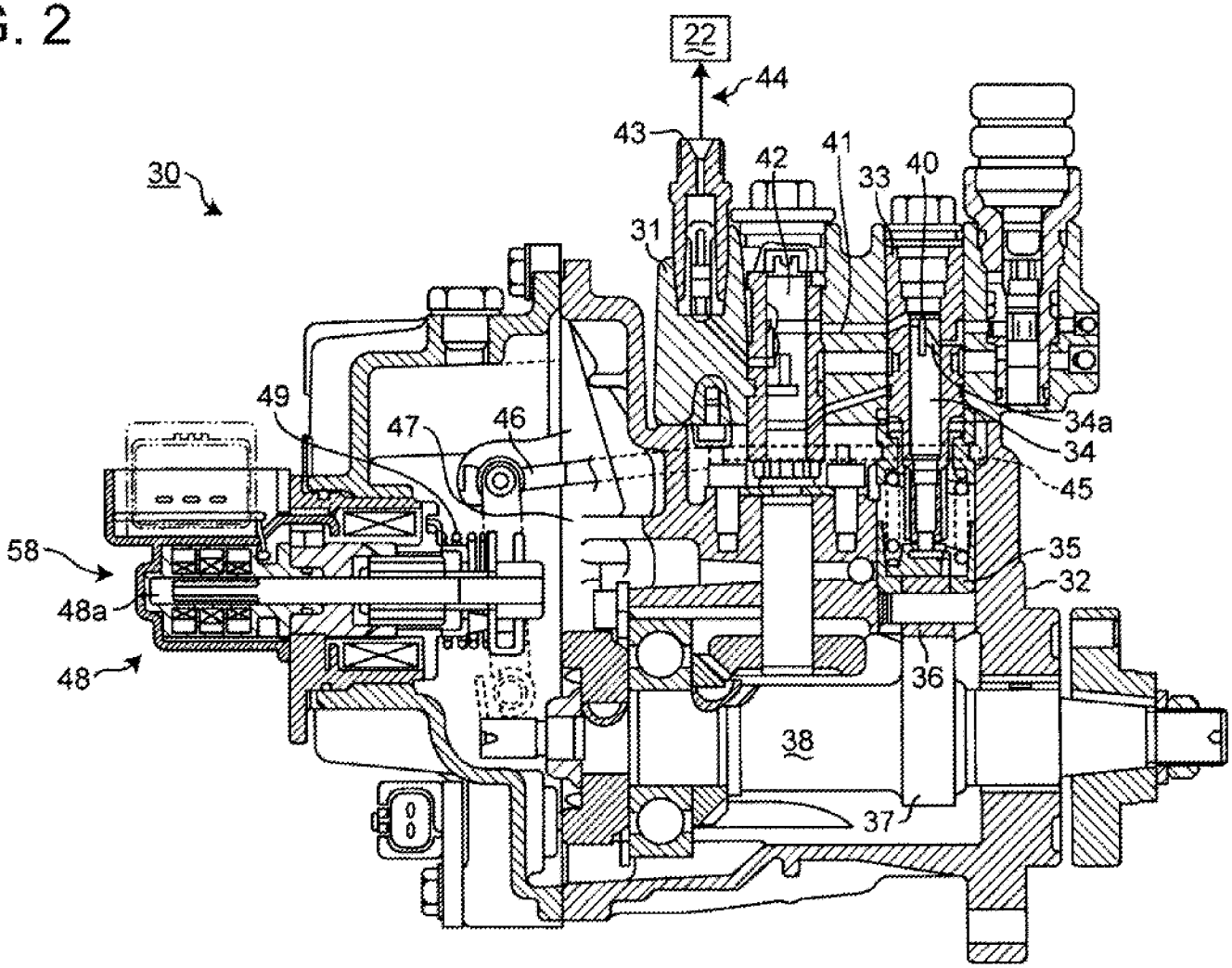

FIG. 2 is a schematic cross-sectional view of the fuel injection pump 30.

The fuel injection pump 30 includes a hydraulic head 31 and a pump housing 32. The pump housing 32 is joined to a lower portion of the hydraulic head 31. In the hydraulic head 31, a plunger barrel 33 is disposed by insertion. In the plunger barrel 33, a plunger 34 is disposed by insertion so as to be slidable in an up-down direction. The plunger 34 has a plunger lead 34*a* formed on an outer circumferential side surface thereof. The plunger lead 34*a* is a spiral groove. A lower spring bearing 35 which is freely slidable in the up-down direction is disposed below the plunger 34 with a spring interposed therebetween. A lower end portion of the lower spring bearing 35 is rotatably and pivotally supported on a roller tappet 36. The tappet 36 is in contact with a cam 37. The cam 37 is fixed to a cam shaft 38. The cam shaft 38 is connected to the crankshaft 16 (see FIG. 1) of the engine body 10 via a not-illustrated gear. Rotation of the crankshaft 16 causes rotation of the cam shaft 38 (cam 37), which results in up and down stroke movements of the plunger 34.

Figure 3:
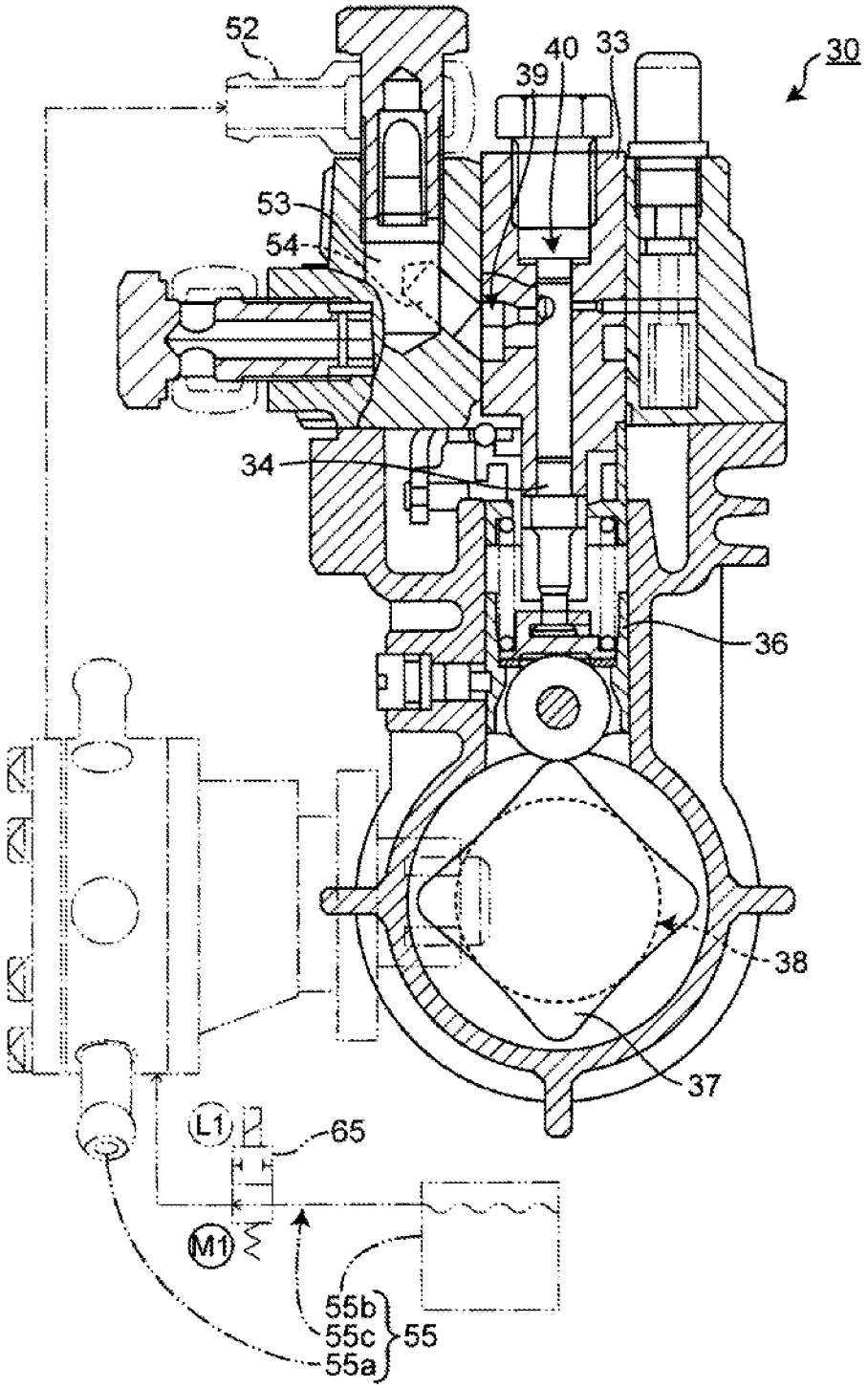
FIG. 3 A schematic cross-sectional view of the fuel injection pump of FIG. 2 in the axial direction of a cam shaft FIG. 4 A map showing the relationship of a dither frequency and an engine revolution number to whether or not a periodic variation in rotation occurs in the engine of this embodiment FIG. 5 A control flowchart that is executed by a control device of the engine of this embodiment

FIG. 3 is a schematic cross-sectional view of the fuel injection pump 30 in the axial direction of the cam shaft 38.

The fuel supply unit 55 supplies a fuel to the fuel injection pump 30. As shown in FIG. 3, the plunger barrel 33 has a main port 39, and a fuel fed under pressure from the fuel supply unit 55 is supplied to the main port 39.

The fuel supply unit 55 includes a pump (feed pump) 55*a*, a fuel tank 55*b*, and a fuel supply pipe 55*c*. The pump 55*a* is connected to the cam shaft 38, and driven along with rotation of the cam shaft 38 (that is, stroke movements of the plunger 34). The pump 55*a* is connected to the fuel tank 55*b* via the fuel supply pipe 55*c*. The pump 55*a* is connected to a fuel gallery 54 via a pipe joint 52 and a fuel supply passage 53 provided in an upper portion of the fuel injection pump 30. The fuel gallery 54 is connected to the main port 39. Driving the pump 55*a* causes a fuel contained in the fuel tank 55*b* to be fed under pressure and supplied to the main port 39 through the fuel supply pipe 55*c*, the pipe joint 52, the fuel supply passage 53, and the fuel gallery 54.

Referring to FIG. 2 and FIG. 3, when the plunger 34 moves to a lowest position (bottom dead center) within its up-down movable range, a fuel pressure chamber 40 provided in the plunger barrel 33 communicates with the main port 39, so that the fuel is introduced to the fuel pressure chamber 40. When the plunger 34 is pushed by the cam 37 to rise, an outer wall of the plunger 34 closes a communication port of the main port 39 communicating with the fuel pressure chamber 40. As a result, the fuel in the fuel pressure chamber 40 is compressed as the plunger 34 rises, and is sent to a distributor shaft 42 via a distribution port 41. The distributor shaft 42 distributes the fuel, which has been fed under pressure, to a delivery valve 43. Then, the fuel passes through an injection pipe 44, and is injected from the fuel injection nozzle 22 of the engine body 10, to be supplied into the combustion chamber 17 (see FIG. 1).

Referring to FIG. 2 and FIG. 3, when the plunger 34 further rises, the plunger lead 34*a* formed in the plunger 34 communicates with the main port 39, and in addition, the inside of the plunger barrel 33 communicates with the main port 39. This causes the fuel in the plunger barrel 33 to flow back to the fuel supply unit 55 side of the main port 39, and fuel injection performed by the fuel injection pump 30 is stopped.

Referring to FIG. 2, the plunger 34 has a gear (not shown) on an outer circumferential surface thereof, and the gear is meshed with a rack (fuel metering rack) 45. The rack 45 is reciprocably supported on the pump housing 32. The rack 45 is supported so as to be reciprocable between a first side position and a second side position. The rack 45 is connected to a slide shaft 48*a* of an actuator (solenoid) 48 via a control lever 46 and a link lever 47. In the fuel injection pump 30, an electronic governor 58 is constituted by the rack 45, the actuator 48, and the like.

A governor spring 49 is provided between the slide shaft 48*a* of the actuator 48 and the link lever 47. The governor spring 49 biases the rack 45 to the first side position via the link lever 47. Thus, while the actuator 48 is in non-conducting state, the rack 45 is in the first side position within the movable range, that is, within the range from the first side position to the second side position (including the first side position and the second side position).

The actuator 48 reciprocates the slide shaft 48*a*, to thereby reciprocate the rack 45 via the link lever 47 and the control lever 46. As the actuator 48 reciprocates the rack 45, the plunger 34 rotates about its axis. Since the rotation position of the plunger 34 is changed by the actuator 48, a timing when the plunger lead 34*a* communicates with the main port 39 during a rise of the plunger 34 is changed. In this manner, the amount of fuel injected by the fuel injection pump 30 is changed.

As shown in FIG. 1, a position detection device 50 is connected to the rack 45, the position detection device 50 detecting the position of the rack 45. An output value detection device 51 is connected to the actuator 48, the output value detection device 51 detecting an output value of the actuator 48 (the value of a current flowing in the actuator 48). A revolution number detection device 73 detects the revolution number of the crankshaft 16.

The position detection device 50 outputs a signal indicating the position of the rack 45 to the control device 70, and the output value detection device 51 outputs a signal indicating the output value of the actuator 48 to the control device 70. The revolution number detection device 73 outputs a signal indicating the revolution number of the crankshaft 16 to the control device 70.

The starter 60 has an electric motor, to start the engine. The shut-off valve 65 is provided in the fuel supply pipe 55*c*. The shut-off valve 65 is made of, for example, a solenoid valve, and is configured to switch a fuel passage between a position L1 and a position M1 by sliding a spool so as to open and close the fuel supply pipe 55*c*.

When the spool of the shut-off valve 65 is in the position L1 (closed state), the fuel supply pipe 55*c* is blocked and therefore no fuel is supplied from the fuel supply unit 55 to the fuel injection pump 30. This creates a state where the fuel is not able to jet out of the fuel injection pump 30, and a state where the fuel is not able to be supplied from the fuel injection pump 30 into the combustion chamber 17.

When the spool of the shut-off valve 65 is in the position M1 (open state), the fuel supply pipe 55*c* is opened, so that the fuel is supplied from the fuel supply unit 55 to the fuel injection pump 30. This creates a state where the fuel is able to jet out of the fuel injection pump 30, and a state where the fuel is able to be supplied from the fuel injection pump 30 into the combustion chamber 17. Although in this embodiment the shut-off valve 65 is made of a solenoid valve, another member capable of opening and closing the fuel supply pipe can be adopted instead of the shut-off valve.

The control device 70 controls operations of the actuator 48 and the starter 60. As shown in FIG. 1, a key switch 80 is connected to the control device 70. The key switch 80 is an operation tool for starting and stopping the engine. The position of the key switch 80 is changeable to any of OFF position, ON position, and START position. When the key switch 80 is operated into the OFF position, the starter 60 and the control device 70 are not conducting and are stopped. When the key switch 80 is operated into the ON position, the actuator 48, the starter 60, and the control device 70 are conducting and are in an actuatable state. As the key switch 80 is operated from the ON position to the START position, the control device 70 actuates the starter 60 and executes various control programs for starting the engine.

The control device 70 includes a memory and a processing circuit corresponding to a processor such as a CPU. As for various determinations performed by the control device 70 which will be described later, functions of elements for performing these determinations may be implemented by, for example, the processor executing programs stored in the memory. Alternatively, the control device 70 may include an integrated circuit that implements functions of these elements.

The control device 70 is connected to the shut-off valve 65, and controls operations of the shut-off valve 65. The control device 70 is connected to the starter 60, and operates the starter 60 to rotate the crankshaft 16, thereby causing stroke movements of the plunger 34. The control device 70 operates the starter 60 to rotate the crankshaft 16, thereby starting the engine.

The control device 70 is connected to the position detection device 50, and obtains information from the position detection device 50, the information representing a detection value of the position of the rack 45. The control device 70 is connected to the output value detection device 51, and obtains information from the output value detection device 51, the information representing a detection value of the output value of the actuator 48.

The control device 70 is connected to the actuator 48, and operates the actuator 48 to change the position of the rack 45, thereby changing the rotation position of the plunger 34. The control device 70 changes the rotation position of the plunger 34, to thereby regulate the amount of fuel injected by the fuel injection pump 30. The control device 70 is also able to regulate the engine revolution number by controlling the fuel injection pump 30 and the shut-off valve 65 based on at least one signal out of the signal indicating the engine revolution number received from the revolution number detection device 73, the signal indicating the position of the rack 45 received from the position detection device 50, and the signal indicating the output value of the actuator 48 received from the output value detection device 51.

To reduce friction in a movable part of the actuator 48, the control device 70 performs a dither control, which means a control for exciting the movable part at a specific frequency. The dither control enables the actuator 48 to slide smoothly, thus improving the controllability of fuel injection.

The present inventors discovered that performing such a dither control may sometimes cause a periodic variation in the engine speed to occur at a specific engine speed.

The present inventors also discovered that the periodic variation may sometimes lead to a harsh noise (audible sound).

FIG. 4 is a map showing the relationship of a dither frequency and an engine revolution number to whether or not a periodic variation in rotation occurs.

In FIG. 4, the leftmost column shows the dither frequency [Hz] in the dither control, and the other columns (except the uppermost row) contain numerals each representing an engine revolution number [$min^{-1}$(rpm)]. Among the engine revolution numbers, each of underlined revolution numbers is such a revolution number (that is, a dangerous revolution number) that a periodic variation in rotation due to the dither control occurs within a revolution number range of ±20 [$min^{-1}$] from this revolution number. Among the engine revolution numbers, each of not-underlined revolution numbers is such a revolution number that a periodic variation in rotation due to the dither control does not occur within a revolution number range of ±20 [$min^{-1}$] from this revolution number.

Referring to FIG. 4, it can be seen that, for example, when the dither frequency is 178.6 [Hz], a periodic variation in rotation due to the dither control did not occur within revolution number ranges of 10716±20 [$min^{-1}$], 5358±20 [$min^{-1}$], 3572±20 [$min^{-1}$], and 2679±20 [$min^{-1}$]. Referring to FIG. 4, it can be seen that, for example, when the dither frequency is 178.6 [Hz], a periodic variation in rotation due to the dither control occurred within revolution number ranges of 2143±20 [$min^{-1}$], 1786±20 [$min^{-1}$], 1531±20 [$min^{-1}$], 1340±20 [$min^{-1}$], and 1191±20 [$min^{-1}$].

The control device 70 includes a storage unit 71 (see FIG. 1). The storage unit 71 prestores the map of FIG. 4, that is, a map showing the relationship of whether or not a periodic variation in rotation occurs relative to the relationship (combination) between the dither frequency in the dither control and the engine revolution number. In this embodiment, this map is one example of information of a revolution number variation region; and each dangerous revolution number and a revolution number band of ±20 [$min^{-1}$] from the dangerous revolution number, which are shown in the map, serve as a revolution number variation region.

Figure 5:
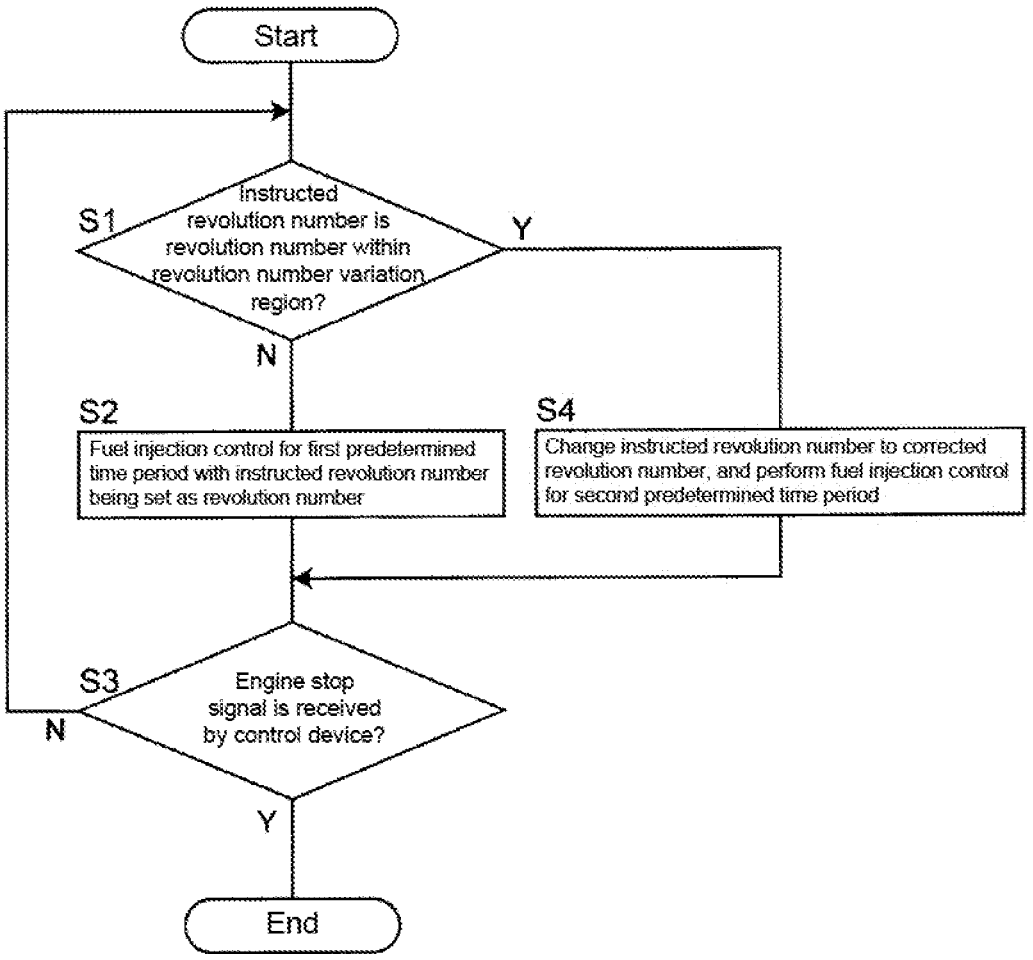

FIG. 5 shows a flowchart of a control executed by the control device 70.

Operating the key switch 80 from the ON position to the START position makes the engine 100 start, so that the control starts. The start of the engine 100 is followed by step S1 in which the control device 70 accesses the storage unit 71 to obtain a map (information of a revolution number variation region), and based on the map, determines whether or not an instructed revolution number is a revolution number within the revolution number variation region. Here, the revolution number variation region means such an engine revolution number region (for example, a revolution number band of ±20 [$min^{-1}$] from the dangerous revolution number) that a periodic variation in rotation occurs due to the dither control. The revolution number variation region is determined for each dither frequency. The instructed revolution number is a command value of the revolution number of the engine 100 which is inputted to the control device 70 by, for example, an operator operating an accelerator of the engine 100. It may be also acceptable that the control device 70 calculates the instructed revolution number based on an accelerator position signal.

If the control device 70 determines that the instructed revolution number is not a revolution number within the revolution number variation region in step S1, the processing proceeds to step S2. In step S2, the control device 70 performs a fuel injection control for a first predetermined time period with the instructed revolution number being set as the revolution number. The fuel injection control is performed by regulation of the engine revolution number. To be specific, the control device 70 performs the fuel injection control by controlling the fuel injection pump 30 and the shut-off valve 65 based on the signal indicating the engine revolution number received from the revolution number detection device 73, the signal indicating the position of the rack 45 received from the position detection device 50, and the signal indicating the output value of the actuator 48 received from the output value detection device 51. Then, the processing proceeds to step S3.

In step S3, the control device 70 determines whether or not an engine stop signal is received, and in other words, whether or not the key switch 80 is operated into the OFF position. If the control device 70 determines that an engine stop signal is received in step S3, the control ends. If the control device 70 determines that no engine stop signal is received, the processing returns to step S1.

If the control device 70 determines that the instructed revolution number is a revolution number within the revolution number variation region in step S1, the processing proceeds to step S4. Then in step S4, the control device 70 performs the fuel injection control while changing the instructed revolution number to a revolution number that is outside the revolution number variation region. To be specific, the control device 70 adds a predetermined revolution number $\alpha$ to the instructed revolution number which is within the revolution number variation region, to obtain a resulting revolution number as a corrected revolution number, and performs the fuel injection control for a second predetermined time period that corresponds to the corrected revolution number. The predetermined revolution number $\alpha$ may be any positive revolution number, but it desirably has such a numerical value that an instructed revolution number that is within a revolution number band of ±20 from the dangerous revolution number becomes a revolution number that is outside the band as a result of the predetermined revolution number $\alpha$ being added thereto. In view of this, in an example of this embodiment, a value of approximately 20 [$min^{-1}$] is adopted as the predetermined revolution number $\alpha$, for example.

The fuel injection control is performed by the control device 70 regulating the engine revolution number by controlling the fuel injection pump 30 and the shut-off valve 65 based on the signal indicating the engine revolution number received from the revolution number detection device 73, the signal indicating the position of the rack 45 received from the position detection device 50, and the signal indicating the output value of the actuator 48 received from the output value detection device 51. Then, the processing proceeds to step S3. The second predetermined time period may be a time period either equal to or different from the first predetermined time period. In this regard, however, to increase the revolution number of the engine 100 under a constant fuel pressure by performing the fuel injection control for the second predetermined time period, the second predetermined time period is longer than the first predetermined time period.

In this embodiment, the control device 70 changes the engine revolution number (instructed revolution number) so as to avoid the revolution number variation region in which a periodic variation in the revolution number occurs due to the dither control. This can reduce occurrence of a periodic variation in the revolution number while performing the dither control. Accordingly, an unpleasant audible sound can be reduced.

Since the control device 70 avoids the revolution number variation region by controlling the fuel injection device 90, the unpleasant audible sound can be reduced with a simple configuration.

In the embodiments described above, upon the control device 70 determining that the instructed revolution number is within the revolution number variation region, the control device 70 adds the predetermined revolution number $\alpha$ to the instructed revolution number, to obtain a resulting revolution number as a corrected revolution number, and performs the fuel injection control based on the corrected revolution number. Instead of this, a configuration may be conceivable in which upon the control device determining that the instructed revolution number is within the revolution number variation region, the control device subtracts a predetermined revolution number β from the instructed revolution number, to obtain a resulting revolution number as a corrected revolution number, and performs the fuel injection control based on the corrected revolution number. Although the predetermined revolution number β may be either equal to or different from the predetermined revolution number α, it desirably has such a numerical value that an instructed revolution number that is within a revolution number band of ±20 [$min^{-1}$] from the dangerous revolution number becomes a revolution number that is outside the band as a result of the predetermined revolution number β being subtracted therefrom.

A configuration may also be conceivable in which upon the control device 70 determining that the instructed revolution number is within the revolution number variation region, the control device 70 performs a control of changing only the dither frequency of the actuator 48 so as to bring a combination of the dither frequency and the engine revolution number out of the revolution number variation region. Alternatively, the control device 70 may change both the instructed revolution number and the dither frequency so as to bring a combination of the dither frequency and the engine revolution number out of the revolution number variation region.

The determination of whether or not a combination of the dither frequency and the engine revolution number is within the revolution number variation region may not always need to be based on the map of FIG. 4 which is prestored in the storage unit 71. Instead of this, for example, a configuration may be conceivable in which: states and conditions of a periodic variation in rotation which actually occurs while the engine is driving are detected so that the control device learns; thereby a dangerous revolution number is identified and a revolution number variation region is prepared; and the determination is performed based on the revolution number variation region thus prepared.

The control device may determine that a periodic variation in rotation due to the dither control is occurring if, for example, at least one condition is satisfied among conditions that: a revolution number variation width (a value obtained by subtracting the minimum value from the maximum value) is more than a predefined value and a variation in rotation is periodic; a rack position variation width (a range in which the rack exists in a case where the rack position varies) is more than a predefined value and a variation in the rack position is periodic; and a fuel injection amount variation width (a value obtained by subtracting the minimum value of the injection amount per second from the maximum value of the injection amount per second in a case where the injection amount varies) is more than a predefined value and a variation in the injection amount is periodic. The control device may prepare the revolution number variation region based on at least one type of information among the above-mentioned types of information, namely, information of the revolution number, information of the rack position, and information of the amount of injected fuel.

The engine of the present invention may be diesel engines of any specifications not depending on the number of cylinders. The engine of the present invention may be engines other than diesel engines. The engine of the present invention may be any engine as long as it is an engine that performs a dither control on an actuator for controlling the position of a rack.

By properly combining optional ones of the various embodiments above, their respective advantages can be exerted.

Although the present invention has been fully described in connection with the preferred embodiments thereof with reference to the accompanying drawings, it is to be noted that various changes and modifications are apparent to those skilled in the art. Such changes and modifications are to be understood as included within the scope of the present invention as defined by the appended claims unless they depart therefrom.

REFERENCE SIGNS LIST

16 crankshaft
17 combustion chamber
30 fuel injection pump
45 rack
48 actuator
50 position detection device
58 electronic governor
65 shut-off valve
70 control device
71 storage unit
73 revolution number detection device
80 key switch
90 fuel injection device
100 engine

The invention claimed is:

1. An engine comprising:
a fuel injection device including a rack and an actuator;
a revolution number detection device configured to detect an instructed revolution number; and
a control device configured to:
control fuel injection performed by the fuel injection device based on the instructed revolution number,
perform a dither control on the actuator,
determine a dither frequency in the dither control;
determine a revolution number variation region based on a relationship between the dither frequency in the dither control and an engine revolution number, and
based on a determination that the instructed revolution number is within the revolution number variation region:
increase or decrease the engine revolution number relative to the instructed revolution number,
obtain a corrected revolution number that is outside the revolution number variation region, and
control fuel injection performed by the fuel injection device based on the corrected revolution number.

2. The engine according to claim 1, further comprising:
a position detection device configured to detect a position of the rack.

3. The engine according to claim 1, wherein the control device is further configured to prepare the revolution number variation region based on at least one type of information among: information of the instructed revolution number detected by the revolution number detection device, information of a position of the rack detected by a position detection device, and information of an amount of fuel injected by the fuel injection device.

4. The engine according to claim 1, wherein:
the rack is coupled to a pump housing and the rack is movable between a first position and a second position to regulate an amount of fuel injected to a combustion chamber; and
the actuator is coupled to the rack and configured to move the rack between the first position and the second position.

5. A fuel injection system of an engine, the fuel injection system comprising:

a rack coupled to a pump housing, the rack configured to be movable between a first position and a second position to regulate an amount of fuel injected to a combustion chamber;

an actuator coupled to the rack and configured to move the rack between the first position and the second position; and a controller electrically connected to the actuator, the controller configured to:

determine one or more revolution number variation regions based on an engine revolution number and a dither frequency; and based on an instructed engine revolution number being within a particular revolution number variation region of the one or more revolution number variation regions:

alter the engine revolution number;

determine a target revolution number that is outside the particular revolution number variation region; and operate the fuel injection system based on the target revolution number.

6. The fuel injection system of claim 5, wherein the controller is further configured to determine the engine revolution number and the dither frequency.

7. The fuel injection system of claim 5, wherein the controller is further configured to perform a comparison based on the instructed engine revolution number and the one or more revolution number variation regions.

8. The fuel injection system of claim 5, wherein the controller is further configured to, based instructed engine revolution number being outside the particular revolution number variation region of the one or more revolution number variation regions:

set the instructed engine revolution number as the engine revolution number; and operate the fuel injection system based on the engine revolution number.

9. The fuel injection system of claim 5, further comprising:

a storage unit in communication with the controller; and wherein the storage unit is configured to store a control map of the one or more revolution number variation regions.

10. The fuel injection system of claim 5, further comprising:

a revolution number detection device configured to calculate the engine revolution number and transmit the engine revolution number to the controller;

a position detection device configured to determine a position of the rack; and an output value detection device configured to determine an output value of the actuator; and wherein each of the revolution number detection device, the position detection device, and the output value detection device are in communication with the controller.

11. The fuel injection system of claim 5, wherein the controller is further configured to alter the engine revolution number to the target revolution number.

12. A fuel injection system of an engine, the fuel injection system comprising:

a controller configured to operate a fuel injection pump of an engine, the fuel injection pump comprising a rack configured to regulate an amount of fuel injected to a combustion chamber and an actuator configured to move the rack, the controller further configured to:

receive an engine revolution number and a dither frequency from at least one sensor;

determine one or more revolution number variation regions based on the engine revolution number and the dither frequency;

receive an instructed engine revolution number from the at least one sensor;

determine if the instructed engine revolution number is within the revolution number variation regions; and based on a determination that the instructed engine revolution number is within the revolution number variation regions:

alter the dither frequency to a target dither frequency; or alter the instructed engine revolution number to a target engine revolution number; and operate the fuel injection pump based on the target dither frequency or the target engine revolution number.

13. The fuel injection pump of claim 12, wherein the target dither frequency and the target engine revolution number are outside of the revolution number variation regions.

14. The fuel injection pump of claim 12, wherein the controller is further configured to alter the instructed engine revolution number to the target engine revolution number based on the instructed engine revolution number being within the revolution number variation regions.

15. The fuel injection pump of claim 12, wherein, based on the instructed engine revolution number being outside the revolution number variation regions, the controller is configured to:

set the instructed engine revolution number as an operation engine revolution number; and perform a fuel injection control for a first predetermined time period according to the operation engine revolution number.

16. The fuel injection pump of claim 15, wherein during the fuel injection control, the controller is further configured to adjust the fuel injection pump and a shut-off valve.

17. The fuel injection pump of claim 15, further comprising:

a position detection device configured to detect a position of the rack; and an output value detection device configured to detect an output value of the actuator; and wherein the at least one sensor comprises a revolution number detection device configured to detect the instructed revolution number.

18. The fuel injection pump of claim 17, wherein the controller is configured to perform the fuel injection control based on:

a first signal indicating the engine revolution number received from the revolution number detection device, a second signal indicating a position of the rack received from the position detection device, and a third signal indicating an output value of the actuator received from the output value detection device.

* * * * *